US007747183B2

(12) United States Patent
Yamaki

(10) Patent No.: US 7,747,183 B2
(45) Date of Patent: Jun. 29, 2010

(54) IMAGE FORMING APPARATUS

(75) Inventor: Hideo Yamaki, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/331,140

(22) Filed: Dec. 9, 2008

(65) Prior Publication Data

US 2009/0169223 A1 Jul. 2, 2009

(30) Foreign Application Priority Data

Dec. 28, 2007 (JP) ..... 2007-338495

(51) Int. Cl.
*G03G 15/00* (2006.01)

(52) U.S. Cl. ..... 399/43; 399/71; 399/101

(58) Field of Classification Search ..... 399/43, 399/71, 101, 345, 350, 352
See application file for complete search history.

(56) References Cited

U.S. PATENT DOCUMENTS 6,631,249 B2 * 10/2003 Katsumi et al. ..... 399/71
6,959,160 B2 * 10/2005 Yoshida et al. ..... 399/101
7,596,335 B2 * 9/2009 Fukami et al. ..... 399/71

FOREIGN PATENT DOCUMENTS

| | | |
|---|---|---|
| JP | 08-063071 | 3/1996 |
| JP | 2004-325657 | 11/2004 |
| JP | 2006-189798 | 7/2006 |

OTHER PUBLICATIONS

Notice of Reason for Refusal mailed Jan. 26, 2010, directed at application No. 2007-338495, 6 pages.

* cited by examiner

*Primary Examiner*—Hoang Ngo
(74) *Attorney, Agent, or Firm*—Morrison & Foerster LLP

(57) ABSTRACT

An image forming apparatus capable of appropriately cleaning an image carrier is provided. An image forming apparatus 1 including toner cartridges 11Y, 11M, 11C, and 11K, a developing section which forms toner images, an image carrier 4 which carries the toner images formed by the developing section, a transfer member 5 which transfers toner images from the image carrier 4 to a recording sheet S, and a cleaner 14 which is operable for press and release operation to/from the image carrier 4 and which is pressed to the image carrier 4 to scrape off the toner remaining on the image carrier 4 is provided with a control means 23 which decreases the number of press and release operations of the cleaner 14 when the cumulated value of the number of images formed since the first use of the brand-new toner cartridges 11Y, 11M, 11C, and 11K is large.

12 Claims, 5 Drawing Sheets

IMAGE FORMING APPARATUS

This application is based on application No. 2007-338495 filed in Japan, the contents of which are hereby incorporated by reference.

BACKGROUND OF THE INVENTION

The present invention relates to an image forming apparatus.

Image forming apparatuses often use a cleaner blade in order to remove the toner on an image carrier. As described in JP H8-63071 A, when the cleaner blade is kept in pressure contact with the image carrier used for successive monochrome printing, toner coagulates at the top end of the cleaner blade, thereby causing a problem of degraded performance of the cleaner blade.

Accordingly, in the image forming apparatus in JP H8-63071 A, the cleaner blade is temporarily released from the image carrier at intervals between images during monochrome printing, so that coagulations at the top end of the cleaner blade are dropped off by vibration.

Four cycle image forming apparatuses have conventionally conducted color printing by rotating an intermediate transfer belt four turns, so that toner images of four colors are primarily transferred in superimposition on top of each other, and that the toner images of four colors are secondarily transferred onto recording paper collectively. After the secondary transfer is completed, the cleaner blade is pressed to the intermediate transfer belt in order to remove the toner remaining on the intermediate transfer belt, and then the cleaner blade is again released at the time of the next image formation.

In recent years, in order to achieve downsizing and cost reduction of image forming apparatuses, there have been being produced image forming apparatuses which use intermediate transfer belts lacking in a satisfactory level of smoothness and releasability, as well as inexpensive toner cartridges incapable of stirring and homogenizing the internal toner. In these image forming apparatuses, even in color printing in which the cleaner is released once every four rotations, toner or external additives of the toner or the like may coagulate at the top end of the cleaner blade, resulting in degraded performance of the cleaner blade, which may lead to occurrence of a phenomenon called filming that the external additives of the toner are deposited like a film on the intermediate transfer belt, thereby causing degraded image quality.

For downsizing of image forming apparatuses and improvement in their printing speed, some image forming apparatuses have an intermediate transfer belt with a shortened circumferential length so as to decrease the distance between images. In such image forming apparatuses, the intermediate transfer belt needs to be additionally rotated to perform pressing and releasing of the cleaner blade, and excessively increased press and release operations of the cleaner blade would cause a problem of lowered printing speed.

Further, excessive press and release operations of the cleaner blade may make toner float in the image forming apparatus and tend to contaminate the inside of the apparatus, which may deteriorate the maintenanceability and cause trouble and degradation of image quality.

SUMMARY OF THE INVENTION

In view of the problems, an object of the present invention is to provide an image forming apparatus capable of properly cleaning the image carrier.

In order to accomplish the above object, the present invention provides an image forming apparatus including a toner cartridge which contains toner, a developing section which forms a toner image with the toner fed from the toner cartridge, a cleaner which is operable for press and release operation to/from the image carrier and which is pressed to the image carrier to scrape off the toner remaining on the image carrier, and control means which changes a number of press and release operations of the cleaner to/from the image carrier in correspondence to at least one of a cumulated value of number of images formed since first use of the brand-new toner cartridge, temperature of atmosphere, humidity of atmosphere, and density of the toner image.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

Figure 1:
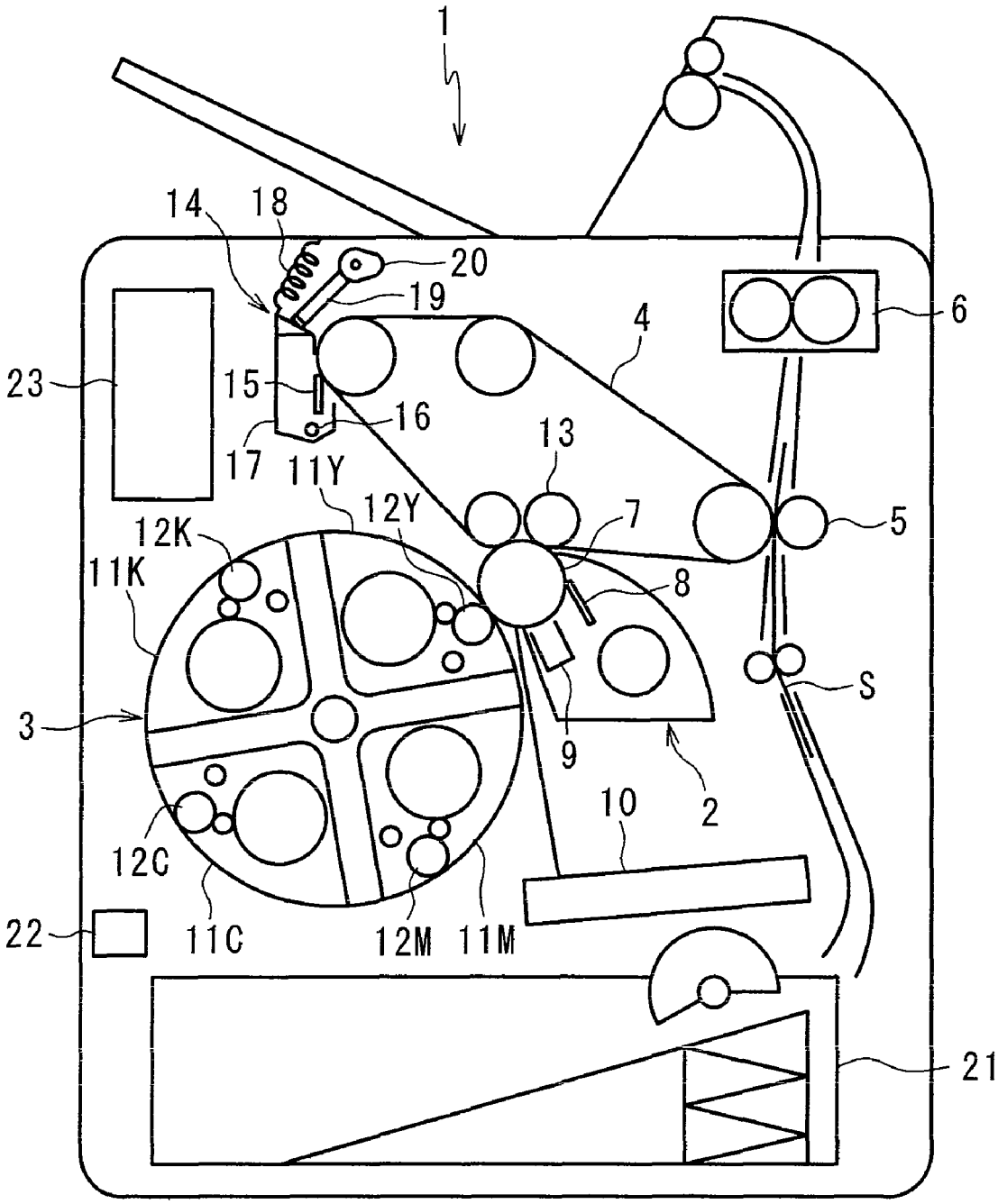
FIG. 1 is a schematic structure view of an image forming apparatus according to a first embodiment of the present invention.

FIG. 1 shows the structure of an image forming apparatus 1 in one embodiment of the present invention. The image forming apparatus 1 of this embodiment includes a developing section composed of a latent image forming section 2 for forming an electrostatic latent image and a development rack 3 for feeding toner to the latent image forming section 2 to develop the electrostatic latent image and thereby form a toner image, an intermediate transfer belt (image carrier) 4 which is an endless belt rotatably provided for receiving the toner image transferred from the latent image forming section 2, a secondary transfer roller 5 which transfers the toner image from the intermediate transfer belt 4 onto a recording sheet S, and a fixing device 6 which applies pressure and heat to the recording sheet S to fix the toner image.

The latent image forming section 2 includes a drum-like photoconductor 7, a photoconductor cleaner 8 which cleans the surface of the photoconductor 7, a charger 9 which charges the photoconductor 7, and an exposure device 10 which selectively exposes the photoconductor 7 to light to form an electrostatic latent image. Toner cartridges 11Y, 11M, 11C, and 11K which respectively contain any one toner in four colors: yellow (Y); magenta (M); cyan (C); and black (K) are loaded into the development rack 3. The toner cartridges 11Y, 11M, 11C, and 11K respectively include developing rollers 12Y, 12M, 12C, and 12K which perform development by attracting toner to the pertinent electrostatic latent images on the photoconductor 7 to form toner images. The development rack 3 is rotatable so as to make any one of the developing rollers 12Y, 12M, 12C, and 12K face the photoconductor 7.

The toner image formed on the photoconductor 7 is transferred by electrostatic force of the primary transfer roller 13 onto the intermediate transfer belt 4. The image forming apparatus 1 also has a belt cleaner 14 which is provided so as to be operable for press and release operation to/from the intermediate transfer belt 4 and which, when pressed to the intermediate transfer belt 4, scrapes off the toner remaining on the intermediate transfer belt 4 left untransferred onto a recording sheet S.

Figure 2:
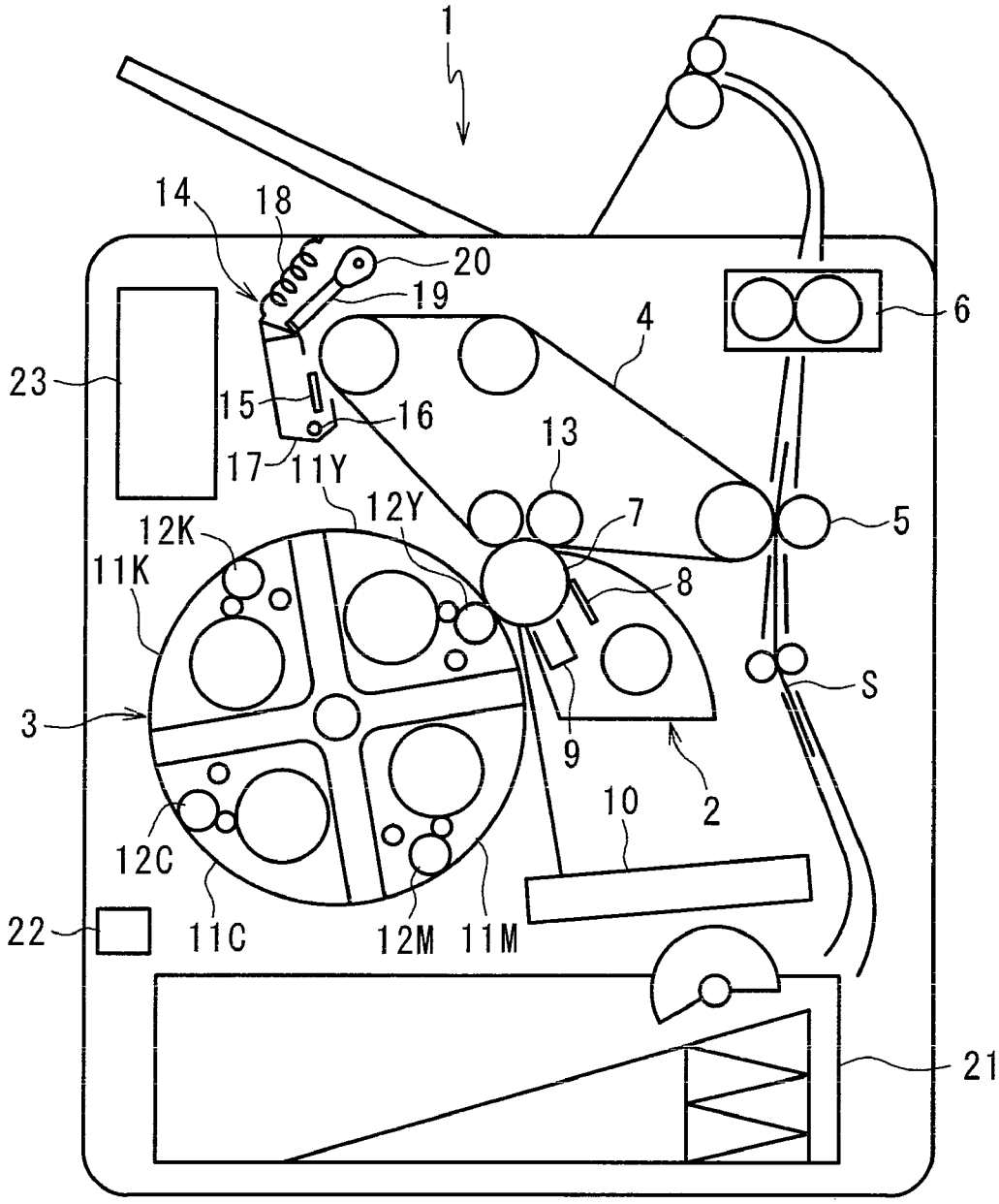
FIG. 2 is a schematic structure view showing the image forming apparatus of FIG. 1 with a belt cleaner being released.

The belt cleaner 14 includes a housing 17 which has a cleaner blade 15 pressed in contact to the intermediate transfer belt 4 and which is pivotably supported by a fulcrum 16 in a swingable manner, a pressing spring 18 which biases the housing 17 toward the intermediate transfer belt 4, and a release cam 20 which swings the housing 17 against the biasing force of the pressing spring 18 via a lever 19 so as to release the cleaner blade 15 from the intermediate transfer belt 4 as shown in FIG. 2.

The image forming apparatus 1 further includes a paper feed tray 21 which can store recording sheets S in layers and send them out one sheet at a time, a temperature and humidity sensor 22 which measures temperature and humidity of the atmosphere, and a control device 23 which controls the operation of each of the aforementioned component members. The control device 23 cumulatively counts the number of images formed (the number of printed sheets) with use of the individual toner cartridges 11Y, 11M, 11C, and 11K since loading of the brand-new toner cartridges 11Y, 11M, 11C, and 11K into the development rack 3.

The image forming apparatus 1 is operated in a monochrome mode in which toner images are formed by using only the black toner, and in a color mode in which color images are formed by using the toner of yellow, magenta, cyan, and black.

Figure 3:
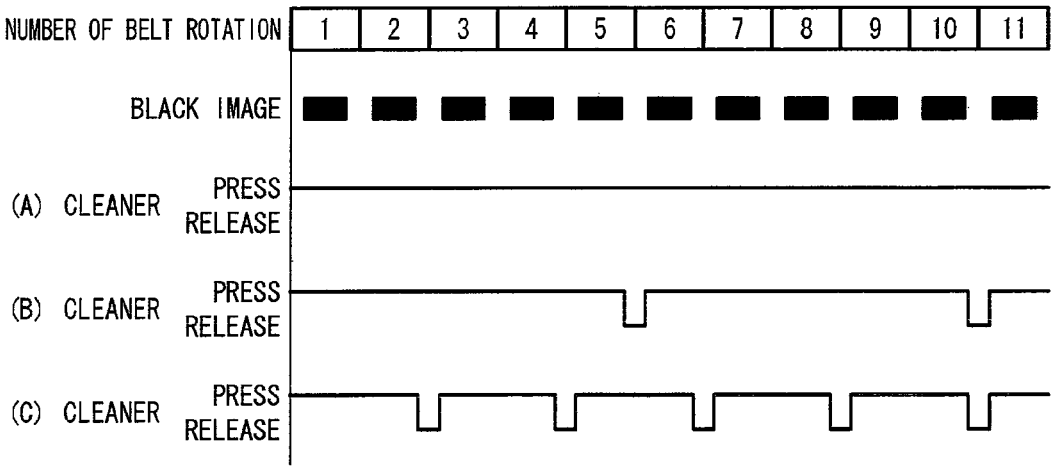
FIG. 3 is a timing chart of image formation in a monochrome mode in the image forming apparatus of FIG. 1.

FIG. 3 shows a timing chart of operation of the image forming apparatus 1 in the monochrome mode. The uppermost row in the figure shows the number of rotations of the intermediate transfer belt 4, while the middle row shows the range in which a black toner image is transferred. The image forming apparatus 1 can form a toner image for one sheet on the intermediate transfer belt 4. The lower rows show the timing of press and release operation of the belt cleaner 14. The drawing is described with a position on the intermediate transfer belt 14 taken as a reference, and therefore congruity between the timing at which the latent image forming section 2 forms an image and the timing at which the belt cleaner 14 is pressed and released in the drawing indicates that, in actual operation, when the latent image forming section 2 forms a toner image on the intermediate transfer belt 4, the toner image is rotated together with the intermediate transfer belt 4, and at the moment when the toner image reaches the belt cleaner 14 without being secondarily transferred, the belt cleaner 14 is pressed to the toner image.

In the monochrome mode, the image forming apparatus 1 performs either one of the following operations: an operation with the belt cleaner 14 being constantly pressed to the intermediate transfer belt 4 without the press and release operation of the belt cleaner 14 (FIG. 3 (A)); an operation with the belt cleaner 14 being temporarily released from the intermediate transfer belt 4 between one toner image and another toner image and then immediately re-pressed thereto, the operation performed whenever toner images for five sheets are formed (FIG. 3 (B)); and an operation with the belt cleaner 14 being released from the intermediate transfer belt and then immediately re-pressed thereto, the operation performed whenever toner images for two sheets are formed (FIG. 3 (C)).

Based on the cumulated value of images formed (the cumulated number of printed sheets) with the toner cartridge 11K, and the humidity of the atmosphere detected by the temperature and humidity sensor 22, the control device 23 determines the frequency of press and release operation of the belt cleaner 14 as shown in the following Table. It is to be noted that the frequency of press and release operation of the belt cleaner 14 may be determined in consideration of other elements such as temperature in addition to the humidity.

TABLE 1

| | | Cumulated number of printed sheets with black cartridge | |
|---|---|---|---|
| Press and release frequency | | 100 sheets or less | Above 100 sheets |
| Humidity | 15% or less | Every two sheets | Without press and release |
| | Above 15% and below 80% | Every five sheets | Without press and release |
| | 80% or more | Every two sheets | Without press and release |

As shown in this table, once the cumulated number of printed sheets with the black toner cartridge 11K exceeds 100 sheets, the image forming apparatus 1 performs image formation without releasing the belt cleaner 14 from the intermediate transfer belt 4. However, when the cumulated number of printed sheets with the black toner cartridge 11K is 100 sheets or less, the image forming apparatus 1 releases and re-presses the belt cleaner 14 from/to the intermediate transfer belt 4 at intervals between images whenever five toner images are formed, i.e., whenever five pages of the recording sheet S are printed under the normal humidity conditions, and whenever two pages are printed under high humidity or low humidity conditions (e.g., relative humidity of 15% or less as well as 80% or more).

As the toner generally contains external additives, the toner and the external additives adhering to the intermediate transfer belt 4 are scraped off by the cleaner blade 15 of the belt cleaner 14. However, if deposits of the toner scraped off from the intermediate transfer belt 4 are layered at the top end of the cleaner blade 15, it becomes hard to scrape off the external additives of the toner from the intermediate transfer belt 4 with the cleaner blade 15. Consequently, the external additives of the toner are deposited on the surface of the intermediate transfer belt 4 so as to form a coat thereon, which may deteriorate the surface characteristics of the intermediate transfer belt 4 and degrade the quality of toner images to be formed. The coat of the external additives generated in this way is called filming.

Generally, it is known that toner cartridges which do not have a function to stir the toner contained therein have higher rates of the content of the external additives at the time of being brand-new products. Although the toner cartridge 11K of this embodiment also comes out with a large amount of external additives at the time of being a brand-new product, the ratio of the external additives is stabilized once the cartridge is used to print about 100 sheets from its first use and therefore the cartridge is so adjusted that the filming no longer occurs even if image formation is performed successively with the belt cleaner 14 remaining pressed to the intermediate transfer belt 4. However, while the toner cartridge 11K is still a brand-new product, the ratio of external additives is high, and therefore successive image formation performed with the toner deposited at the top end of the cleaner blade 15 may cause filming to occur on the surface of the intermediate transfer belt 4.

Only when the cumulated number of printed sheets with the toner cartridge 11K is 100 sheets or less, the image forming apparatus 1 releases and re-presses the belt cleaner 14 from/to the intermediate transfer belt 4 whenever a predetermined number of images are formed. The shock and vibration generated by this release and re-press operation make it possible to brush off the toner and the external additives deposited at the top end of the cleaner blade 15. This enables the cleaner blade 15 to efficiently scrape off the external additives of toner from the surface of the intermediate transfer belt 4, and thereby prevent occurrence of the filming. Moreover, cleaning the top end of the cleaner blade 15 makes it possible to prevent damage and wear of the cleaner blade 15 and the intermediate transfer belt 4 due to toner coagulations.

The image forming apparatus 1 varies the frequency of the press and release operation of the belt cleaner 14 depending on the humidity of the atmosphere. Lower humidities tend to increase the charge amount of the external additives of toner and accelerate adhesion of the external additives to the intermediate transfer belt 4, while higher humidities tend to separate the toner and the external additives and accelerate coagulation of the toner and the external additives and their deposition at the top end of the cleaner blade 15. Therefore, in consideration of this, the frequency of the press and release operation of the belt cleaner 14 is set to be high both when the humidity is equal to or lower than a predetermined lower-limit value (15%) and when the humidity is higher than a predetermined upper-limit value (80%).

Figure 4:
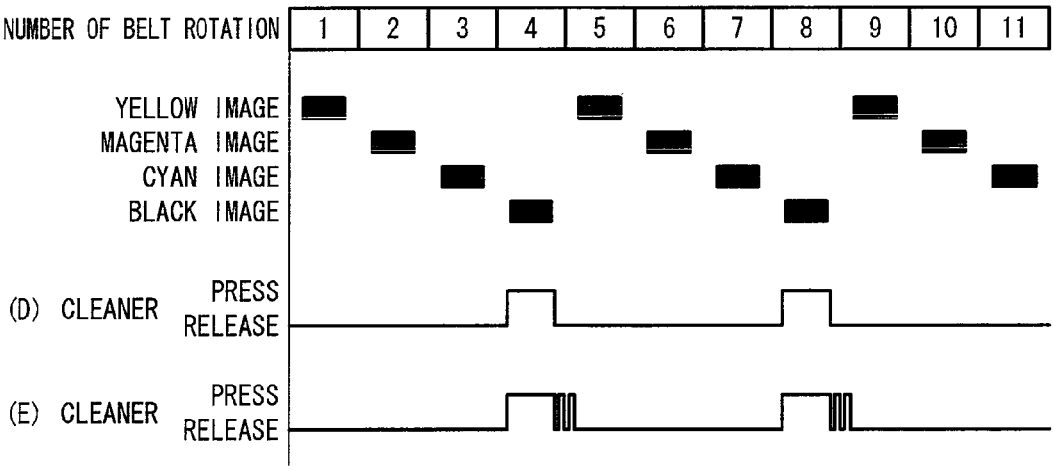
FIG. 4 is a timing chart of image formation in a color mode in the image forming apparatus of FIG. 1.

FIG. 4 shows the operation in the color mode in the image forming apparatus 1. In the color mode, the image forming apparatus 1 transfers toner images of yellow, magenta, cyan, and black onto the intermediate transfer belt 4 in superimposition on top of each other, and transfers them collectively onto a recording sheet S. In this case, forming images of yellow, magenta, cyan, and black in order and transferring them onto the intermediate transfer belt 4 constitute a series of steps for forming an image for one sheet on the intermediate transfer belt 4. That is, the intermediate transfer belt 4 rotates four turns in order to print an image for one recording sheet S. Accordingly, at the timing that the toner images of yellow, magenta, and cyan have been formed, the belt cleaner 14 needs to be released from the intermediate transfer belt 4 in order to hold the toner images, which have passed the secondary transfer roller 5, on the intermediate transfer belt 4. After the formation of the black toner image as the last one of the aforementioned series of steps and the transfer of the toner images of all the colors onto a recording sheet S with the secondary transfer roller 5, the belt cleaner 14 scrapes off the toner left untransferred. Therefore, while an area carrying a toner image on the intermediate transfer belt 4 passes through the position that the cleaner blade 15 is pressed to, the belt cleaner 14 needs to be pressed to the intermediate transfer belt 4. Then, before a yellow image formed on the intermediate transfer belt 4 for the next recording sheet S passes through the position that the cleaner blade 15 is pressed to, the belt cleaner 14 has to be released again.

In this embodiment, under the normal condition as shown in FIG. 4 (D), the belt cleaner 14 is pressed to the intermediate transfer belt 4 at an interval between a cyan image and a black image, and is held as it is released from the intermediate transfer belt 4 at an interval between the black image and a next yellow image. In short, during image formation in the normal color mode, the belt cleaner 14 is pressed to the intermediate transfer belt 4 only once in printing of one recording sheet S. Herein, the terms "an interval between a cyan image and a black image" refer to a space between the rear end of the cyan image and the front end of the black image after the cyan image has been transferred onto the intermediate transfer belt 4 and before the black image is transferred thereto, i.e., an area behind the cyan image and ahead of the black image in the rotational direction of the intermediate transfer belt 4. Similarly, the terms "an interval between the black image and a next yellow image" refers to a space between the rear end of the black image and the front end of the next yellow image.

However, as shown in Table 2 below, the image forming apparatus 1 presses the belt cleaner 14 to the intermediate transfer belt 4 three times in printing of one recording sheet S only when the smallest total number among the total numbers of images formed (the cumulated number of printed sheets) with use of toner cartridges 11Y, 11M, 11C, and 11K, respectively, is five sheets or less, and moreover the atmospheric humidity is low (15% or less) or high (80% or more).

TABLE 2

| Number of press and release operations | | Minimum value of cumulated numbers of printed sheets with cartridge | |
|---|---|---|---|
| every one sheet | | 5 sheets or less | Above 5 sheets |
| Humidity | 15% or less | 3 times | Once |
| | Above 15% and below 80% | Once | Once |
| | 80% or more | 3 times | Once |

Pressing the belt cleaner 14 three times indicates as shown in FIG. 4 (E) that an operation, which is composed of a step of pressing the belt cleaner 14 at an interval between a cyan image and a black image immediately before the passing of the area where the black image has been formed and another step of releasing the belt cleaner 14 immediately after the passing of the area where the black image has been formed, is counted as the first press and release operation, and that the press and release operation is further repeated twice so that the belt cleaner 14 is pressed for a short period of time twice at an interval between the black image and a next yellow image.

Such short-time press and release operation at intervals between images can shake off the toner and the external additives deposited at the top end of the cleaner blade 15, and the cleaner blade 15 can ensure that the toner and the external additives on the intermediate transfer belt 4 are scraped off, so that occurrence of filming can be prevented even in the low-humidity environment or the high-humidity environment. In particular, it becomes possible to prevent the cleaner blade 15 form being damaged by toner coagulations remaining at the top end of the cleaner blade 15 for a long period of time in the high-humidity environment.

On the contrary, in the normal humidity condition, the image forming apparatus 1 prevents the toner adhering to the cleaner blade 15 from being scattered inside the apparatus due to performing press and release operation of the belt cleaner 14 more than necessary.

Further in this embodiment, the control device 23 may compute toner image density, that is a ratio of the exposed area in an image, i.e., a ratio (coverage) of dots covered with toner to the total dot count in the entire image based on the data obtained when the exposure device 10 exposes the photoconductor 7 under the conditions that the atmospheric humidity is in the normal range (above 15% and below 80%), and may change the number of press and release operations of the belt cleaner 14 corresponding to the computed value as shown in the following Table 3.

TABLE 3

| | Number of press and release operations | Minimum value of cumulated numbers of printed sheets with cartridge | |
|---|---|---|---|
| | every one sheet | 5 sheets or less | Above 5 sheets |
| Image density | Below 50% | Once | Once |
| | 50% or more | Every two sheets | Once |
| | | Once/Twice | |

It is to be noted that in Table 3, as in Table 2, an operation, which is composed of the step of pressing the belt cleaner 14 at an interval between a cyan image and a black image immediately before the passing of the area where the black image has been formed and the step of releasing the belt cleaner 14 immediately after the passing of the area where the black image has been formed, is counted as the first press and release operation.

According to this control, when the toner image density is 50% or more, a short-time pressing of the belt cleaner 14 at an interval between images immediately after the passing of the area where a black toner image has been formed is not performed in the printing of the first sheet, and in the printing of the second sheet, the belt cleaner 14 is pressed once (second press and release operation) for a short period of time at an interval between images after the passing of the black toner image. In the intervals between images afterward, the control without the second press and release operation and the control with the second press and release operation are repeated. Since this control is performed only when the minimum value of the cumulated numbers of printed sheets is five sheets or less, the short-time pressing of the belt cleaner 14 is performed substantially at intervals between images only immediately after the printing of the second sheet and the fourth sheet.

As described above, the image forming apparatus 1 predicts the likelihood of occurrence of the filming based on a cumulated value of the number of images formed since the first use of the brand-new toner cartridges 11Y, 11M, 11C, and 11K, a humidity of the atmosphere, and a density of a toner image, and performs a minimum number of the press and release operations of the belt cleaner 14 that can prevent filming, so that the scattering of the toner can be suppressed.

Description is now given of an image forming apparatus 1 according to a second embodiment of the invention. Since the mechanical constitution of this embodiment is generally the same as that of the first embodiment shown in FIG. 1 and FIG. 2, the illustration and description thereof will be omitted. However, this embodiment is different from the first embodiment only in the point that the intermediate transfer belt 4 is slightly longer than the length of a toner image which can be formed. Therefore, in this embodiment, intervals between images are shorter, and therefore there is no time allowance for releasing and re-pressing the belt cleaner 14 at the intervals between images.

Figure 6:
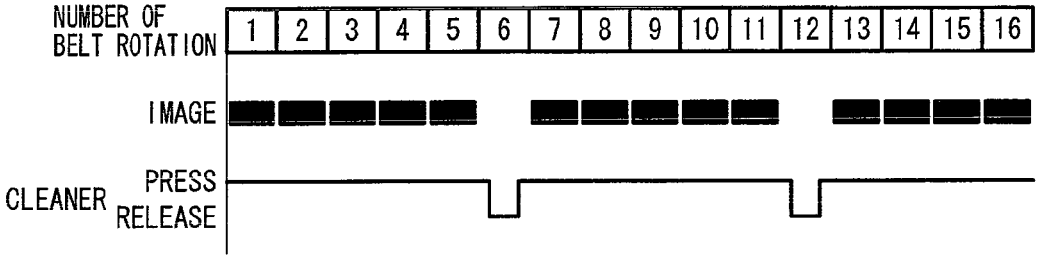
FIG. 6 is another timing chart of image formation in a monochrome mode in the image forming apparatus of the second embodiment of the invention.
Figure 7:
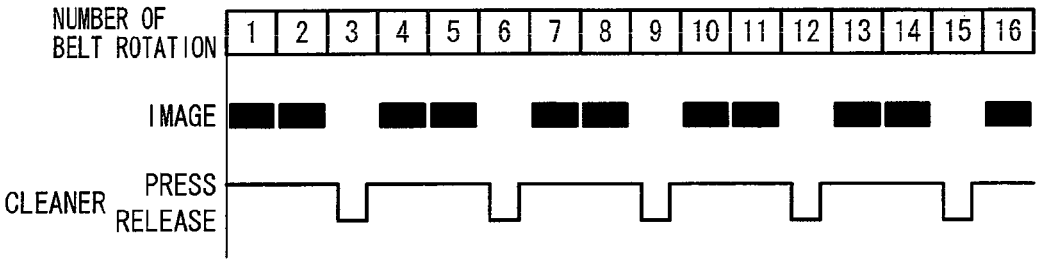
FIG. 7 is still another timing chart of image formation in a monochrome mode in the image forming apparatus of the second embodiment of the invention.

Also in this embodiment, the control device 23 controls the press and release frequency of the belt cleaner 14 corresponding to the cumulated number of printed sheets with toner cartridge 11K and atmospheric humidity as shown in Table 1. Since the interval between toner images is short in this embodiment, only either the pressing of the belt cleaner 14 to the intermediate transfer belt 4 or the releasing of the belt cleaner 14 from the intermediate transfer belt 4 can be performed at intervals between successive toner images. Accordingly, in the monochrome mode, the image forming apparatus 1 of this embodiment changes the timing of image formation corresponding to the press and release frequency of the belt cleaner 14 as shown in FIG. 5 to FIG. 7.

Figure 5:
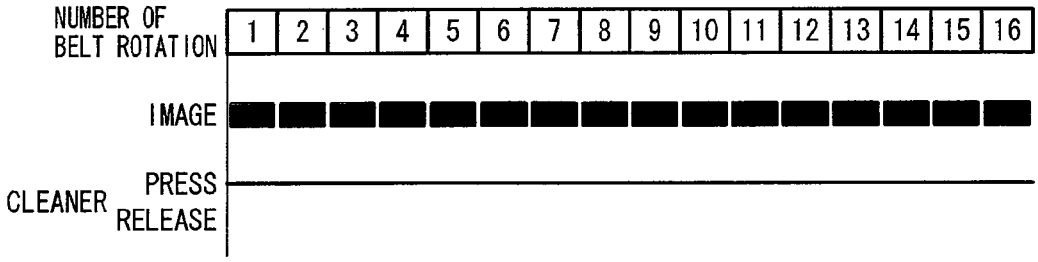
FIG. 5 is a timing chart of image formation in a monochrome mode in an image forming apparatus according to a second embodiment of the invention.

More specifically, in this embodiment, image formation is performed with the belt cleaner 14 being pressed as shown in FIG. 5 when the cumulated number of printed sheets with the black toner cartridge 11K exceeds 100 sheets. However, when the cumulated number of printed sheets with the black toner cartridge 11K is less than 100 sheets, and in the normal humidity conditions, the image forming apparatus 1 temporarily stops toner image formation whenever toner images for five recording sheets S are formed, and additionally rotates the intermediate transfer belt 4 once as shown in FIG. 6. During this additional rotation of the intermediate transfer belt 4, the belt cleaner 14 is released and re-pressed. Further, when the cumulated number of printed sheets with the black toner cartridge 11K is less than 100 sheets, and under low-humidity or high-humidity conditions, the image forming apparatus 1 additionally rotates the intermediate transfer belt 4 once to release and re-press the belt cleaner 14 whenever toner images for two recording sheets are formed as shown in FIG. 7.

Thus, in this embodiment, one additional rotation of the intermediate transfer belt 4 is necessary in order to perform the releasing and the pressing of the belt cleaner 14, which increases an interval between sheets and reduces the printing speed. However, as shown in Table 1, minimizing the press and release frequency of the belt cleaner 14 makes it possible to minimize the degradation of the performance of the image forming apparatus 1, and from the viewpoint of the life cycle of the toner cartridge 11K, reduction in intervals between images achieved by shortening the intermediate transfer belt 4 has a significant effect on improved performance, and also contributes to downsizing of the apparatus.

Figure 8:
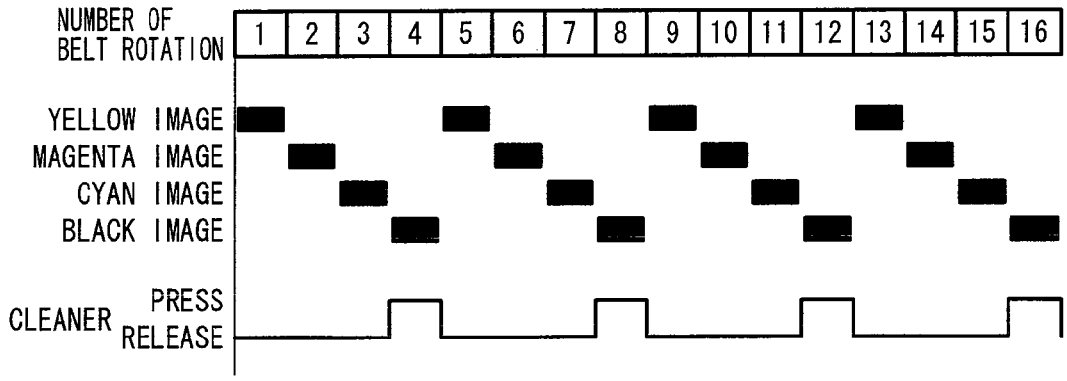
FIG. 8 is a timing chart of image formation in a color mode in the image forming apparatus of the second embodiment of the invention.
Figure 9:
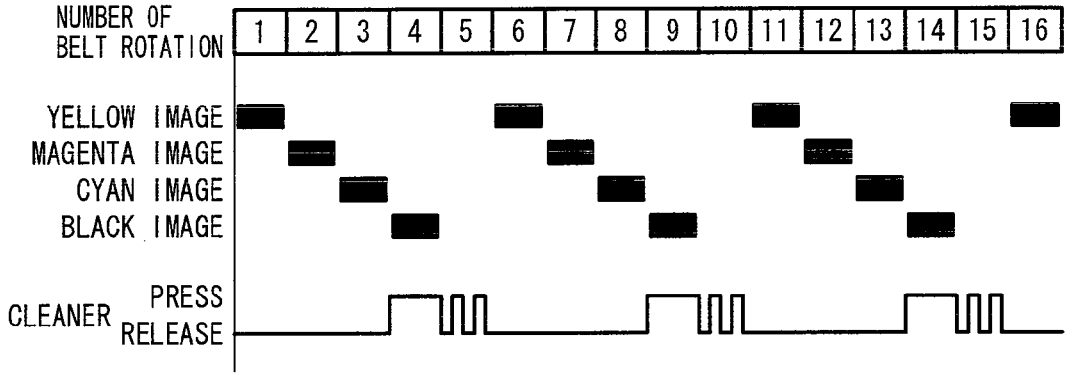
FIG. 9 is another timing chart of image formation in a color mode in the image forming apparatus of the second embodiment of the invention.

FIG. 8 and FIG. 9 show the operation timing of image formation in the color mode in this embodiment. Also in this case, as shown in Table 2, the control device 23 determines the frequency of the press and release operation of the belt cleaner 14. Since an interval between toner images of the respective colors is short in this embodiment, only either the pressing of the belt cleaner 14 to the intermediate transfer belt 4 or the releasing of the belt cleaner 14 from the intermediate transfer belt 4 can be performed at intervals between successive toner images.

In the case of operating one press and release operation for image formation for one sheet, the belt cleaner 14 may be pressed to the intermediate transfer belt 4 at an interval between images immediately before a black toner image, and the belt cleaner 14 may be released from the intermediate transfer belt 4 at an interval between images immediately after the black toner image as shown in FIG. 8. Therefore, in this case, an additional rotation of the intermediate transfer belt 4 is not necessary, and reduction in an interval between images makes it possible to achieve a high printing speed.

Moreover, when either one of the toner cartridges 11Y, 11M, 11C, and 11K is new and is in the low-humidity environment or the high-humidity environment, it becomes possible, as shown in FIG. 9, to make a time duration to press and release the belt cleaner 14 to/from the intermediate transfer belt 4 by additionally rotating the intermediate transfer belt 4 once after formation of a black toner image.

Figure 10:
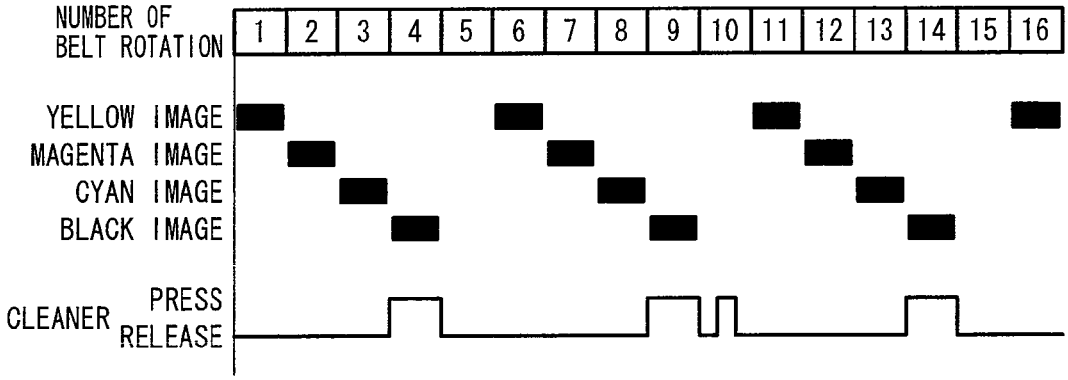
FIG. 10 is still another timing chart of image formation in a color mode in the image forming apparatus of the second embodiment of the invention.

Further, in the case of adding the control based on the density of toner images in Table 3 to this embodiment, one additional rotation of the intermediate transfer belt 4 is performed once every two sheets of image formation as shown in FIG. 10.

As described above, the image forming apparatus according to the present invention includes a toner cartridge which contains toner, a developing section which forms a toner image with the toner fed from the toner cartridge, a cleaner which is operable for press and release operation to/from the image carrier and which is pressed to the image carrier to scrape off the toner remaining on the image carrier, and control means which changes the number of press and release operations of the cleaner to/from the image carrier in correspondence to at least one of a cumulated value of the number of images formed since the first use of the brand-new toner cartridge, temperature of atmosphere, humidity of atmosphere, and density of the toner image.

According to this structure, the likelihood of occurrence of the filming can be determined based on the cumulated value of the number of images formed since the first use of the brand-new toner cartridge, temperature and humidity of the atmosphere, and the density of a toner image, so that the number of press and release operations of the cleaner can be increased only when the filming is likely to occur. Consequently, it becomes possible to perform appropriate cleaning of the cleaner so as to prevent the filming, as well as to prevent damage and wear of the cleaner due to coagulations of toner and external additives. Moreover, when the filming is unlikely to occur, the number of press and release operations of the cleaner can be decreased so that the scattering of toner can be suppressed.

Moreover, according to the image forming apparatus of the invention, the control means may decrease the number of the press and release operations of the cleaner when the cumulated value of the number of images formed since the first use of the brand-new toner cartridge is larger than a predetermined value.

According to this structure, the number of press and release operations of the cleaner is increased when the toner cartridge is new and the toner to be fed contains a large amount of external additives, so that the filming of the external additives can effectively be prevented. Moreover, as the toner cartridge ages, the amount of the external additives in the toner to be fed also decreases, and therefore the filming can be prevented even when the number of press and release operations of the cleaner is decreased to suppress the scattering of the toner.

Moreover, in the image forming apparatus of the invention, the control means may increase the number of press and release operations of the cleaner both when the humidity of the atmosphere is lower than a predetermined lower-limit value and when the humidity of the atmosphere is higher than a predetermined upper-limit value.

According to this structure, in the low-humidity environment which tends to increase the charge amount of external additives and accelerates adhesion of the external additives to the image carrier, or in the high-humidity environment which tends to separate the external additives and toner to generate coagulations of toner, the number of press and release operations of the cleaner is increased, so that the occurrence of the filming can be prevented effectively.

In the image forming apparatus of the invention, the control device may increase the number of press and release operations of the cleaner when the density of the toner image is high.

According to this structure, when the amount of toner is high and so the toner tends to stay more on the cleaner, the number of press and release operations of the cleaner is increased, so that the toner can be shaken off from the cleaner to prevent the occurrence of the filming.

Moreover, according to the present invention, the method for controlling the image forming apparatus which forms a toner image on an image carrier with toner fed from a toner cartridge, transfers the toner image onto recording paper, and scrapes off the toner remaining on the image carrier with a cleaner operable for press and release operation to/from the image carrier is a method including the step for changing the number of press and release operations of the cleaner to/from the image carrier in correspondence to at least one of a cumulated value of number of images formed since first use of the brand-new toner cartridge, temperature of atmosphere, humidity of atmosphere, and density of the toner image.

According to this method, the number of press and release operations of the cleaner can be increased only when the filming is likely to occur, and when the filming is unlikely to occur, the number of press and release operations of the cleaner can be decreased so that the scattering of toner can be suppressed.

Although the present invention has been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. An image forming apparatus, comprising:

a toner cartridge which contains toner;

a developing section which forms a toner image with the toner fed from the toner cartridge;

an image carrier which carries the toner image formed by the developing section;

a cleaner which is operable for press and release operation to/from the image carrier and which is pressed to the image carrier to scrape off the toner remaining on the image carrier; and control means which changes a number of press and release operations of the cleaner to/from the image carrier in correspondence to at least one of a cumulated value of number of images formed since first use of the brand-new toner cartridge, temperature of atmosphere, humidity of atmosphere, and density of the toner image.

2. The image forming apparatus according to claim 1, wherein the control means decreases the number of the press and release operations of the cleaner when the cumulated value of the number of images formed since first use of the brand-new toner cartridge is larger than a predetermined value.

3. The image forming apparatus according to claim 1, wherein the control means increases the number of press and release operations of the cleaner both when the humidity of the atmosphere is lower than a predetermined lower-limit value and when the humidity of the atmosphere is higher than a predetermined upper-limit value.

4. The image forming apparatus according to claim 1, wherein the control device increases the number of press and release operations of the cleaner when the density of the toner image is high.

5. The image forming apparatus according to claim 1, wherein the cleaner is pressed to an image area of the image carrier where the toner image has been carried, and is released and re-pressed at least once from/to the image carrier in an inter-image area between the image areas of the image carrier, and wherein the number of press and release operations of the cleaner to/from the image carrier is changed by changing a number of release and re-press operations in the inter-image area.

6. The image forming apparatus according to claim 1, wherein the image carrier is a rotatable endless belt, and wherein the control means changes the number of release and re-press operations in the inter-image area behind the image area.

7. A method for controlling an image forming apparatus which forms a toner image on an image carrier with toner fed from a toner cartridge, transfers the toner image onto a recording sheet, and scrapes off the toner remaining on the image carrier with a cleaner operable for press and release operation to/from the image carrier, comprising the step of:

changing a number of press and release operations of the cleaner to/from the image carrier in correspondence to depending on at least one of a cumulated value of number of images formed since first use of the brand-new toner cartridge, temperature of atmosphere, humidity of atmosphere, and density of the toner image.

8. The method for controlling the image forming apparatus according to claim 7, wherein the number of press and release operations of the cleaner is decreased when the cumulated value of the number of images formed is larger than a predetermined value.

9. The method for controlling the image forming apparatus according to claim 7, wherein the number of press and release operations of the cleaner is increased both when the humidity of the atmosphere is lower than a predetermined lower-limit value and when the humidity of atmosphere is higher than a predetermined upper-limit value.

10. The method for controlling the image forming apparatus according to claim 7, wherein the number of press and release operations of the cleaner is increased when the density of the toner image is high.

11. The method for controlling the image forming apparatus according to claim 7, wherein the cleaner is pressed to an image area of the image carrier where the toner image has been carried, and is released and re-pressed at least once from/to the image carrier in an inter-image area between the image areas of the image carrier, and wherein the number of press and release operations of the cleaner to/from the image carrier is changed by changing the number of release and re-press operations in the inter-image area.

12. The method for controlling the image forming apparatus according to claim 7, wherein the image carrier is a rotatable endless belt, and wherein the number of release and re-press operations is changed in the inter-image area behind the image area.

* * * * *